United States Patent [19]

Willenbacher

[11] Patent Number: 4,524,703

[45] Date of Patent: Jun. 25, 1985

[54] THREAD CHANGING MECHANISM FOR SEWING MACHINES

[75] Inventor: Erich Willenbacher, Kaiserslautern, Fed. Rep. of Germany

[73] Assignee: Pfaff Industriemaschinen GmbH, Fed. Rep. of Germany

[21] Appl. No.: 589,497

[22] Filed: Mar. 14, 1984

[30] Foreign Application Priority Data

Mar. 17, 1983 [DE] Fed. Rep. of Germany ..... 3309608

[51] Int. Cl.[3] ..... D05B 55/16; D05C 3/02

[52] U.S. Cl. ..... 112/098; 112/221

[58] Field of Search ..... 112/98, 79 R, 79 A, 112/221

[56] References Cited

U.S. PATENT DOCUMENTS

| | | | |
|---|---|---|---|
| 3,695,199 | 10/1972 | Rolaujjs et al. | 112/221 |
| 4,386,522 | 6/1983 | Slomma | 112/221 X |
| 4,474,124 | 10/1984 | Yamazawa | 112/98 X |
| 4,476,793 | 10/1984 | Conrads et al. | 112/221 |

FOREIGN PATENT DOCUMENTS

| | | | |
|---|---|---|---|
| 1927498 | 12/1970 | Fed. Rep. of Germany | 112/221 |
| 1180580 | 2/1970 | United Kingdom | 112/221 |

*Primary Examiner*—H. Hampton Hunter

*Attorney, Agent, or Firm*—McGlew and Tuttle

[57] ABSTRACT

A thread changing mechanism for sewing machines comprises a plurality of needle holders which are received for displacement in a magazine which is fixedly mounted at the level of the top dead center of the needle bar. The needle holders have inner guide surfaces in T-configuration, corresponding to outer T-configuration guide surfaces of the coupling member which is secured to the needle bar. In the middle of the magazine, a recess is provided for the coupled needle holder. In a first embodiment, several fingers are pivotable between the needle holders to space them from each other. The coupled needle holder can then move freely upwardly and downwardly during the sewing operation. In a second embodiment, the same free movement of the coupled needle holder is ensured by a fork by which, after the coupling is effected, the needed spacing between the coupled one and the adjacent needle holders is ensured.

9 Claims, 6 Drawing Figures

50
20
49
48
46
22
47
21
24
25
32
43
45
44
57
53
55
29
6
23
16
9
15
18
8
14
16
14
56
30
57
54
61
55
60
53
22
29
58

71
74
72
75
69
79
78
6
77
70
8
76
78
68
73
72
66
71
67

Fig. 3
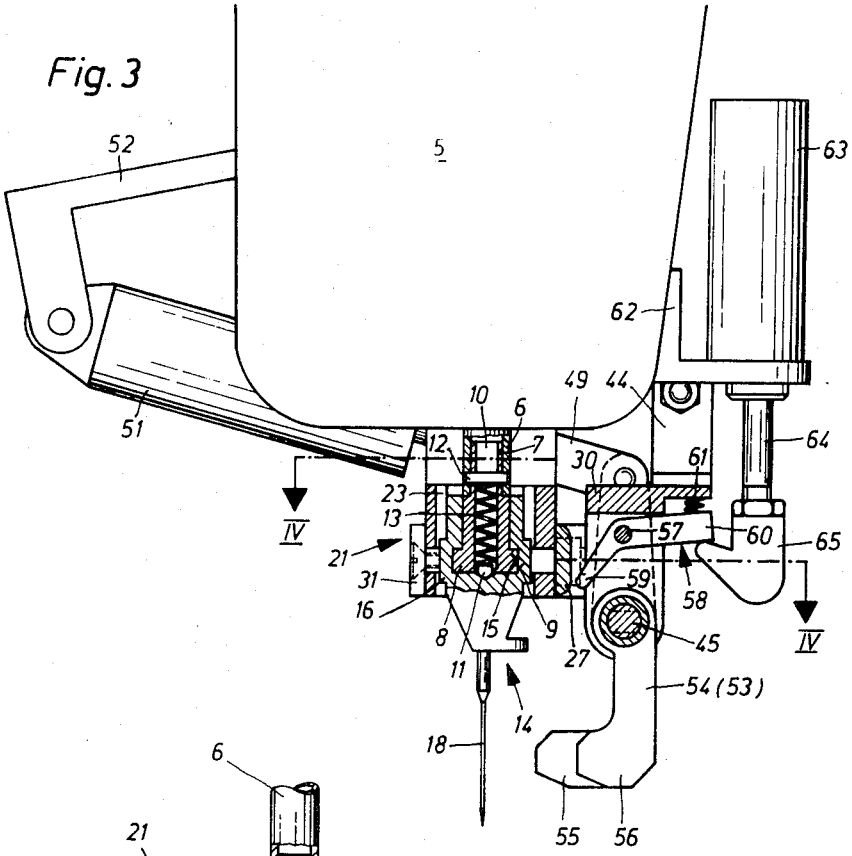
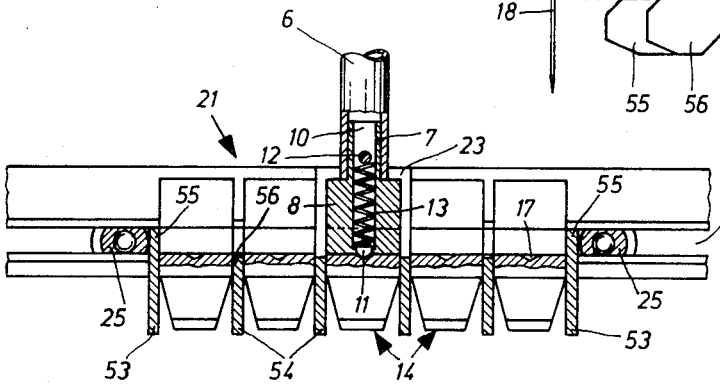
Fig. 5
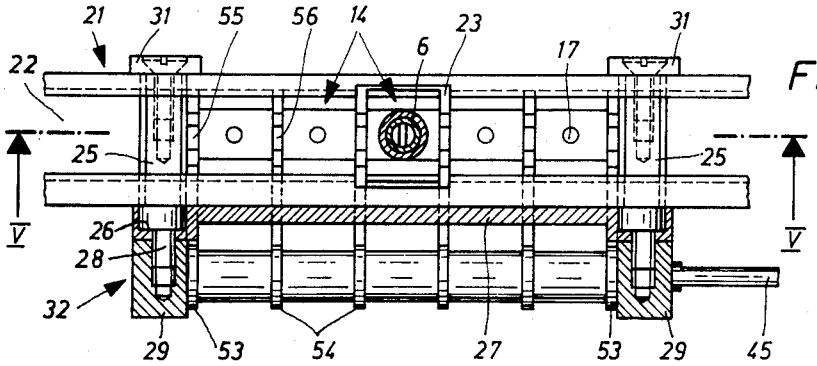
Fig. 4

THREAD CHANGING MECHANISM FOR SEWING MACHINES

FIELD AND BACKGROUND OF THE INVENTION

This invention relates in general to sewing machines and in particular to a new and useful sewing machine having a needle holder magazine.

A prior art thread changing mechanism disclosed in German OS No. 29 27 142 and developed for a small embroidering machine with a plurality of needle bars, provides for each needle bar a magazine which is dsiplaceable transversely to the longitudinal axis of the needle bar and accommodates a plurality of needle holders, each carrying a needle, of which one at a time can be coupled by non-positive coupling means to the needle bar. For changing the thread, the embroidering machine is stopped and the needle bar is lifted above the top dead center of its working stroke to execute a switching stroke by which the needle holder connected to the needle bar is retracted to the magazine and simultaneously uncoupled from the needle bar. As soon as the needle bar at the end of the switching stroke is completely withdrawn from the magazine, the needle holder needed for the next embroidering operation is brought into a standby position by displacing the magazine, whereupon the needle bar is lowered again and the new needle holder is coupled to the needle bar.

In a development of a thread changing mechanism which was accomplished in practice yet not published in print, the non-positive coupling means have been replaced by positive ones. These means comprise stepped inner guide or coupling surfaces of the needle holder, which extend parallel to the direction of displacement of the magazine. At the end of the needle bar, corresponding outer guide or coupling surfaces are provided. To change the thread, again a switching stroke is necessary, above the top dead center of the working stroke. Then, the magazine is displaced, whereby the coupled needle holder is displaced by the next needle holder of the magazine sidewards, away from the needle bar and thus uncoupled and introduced into the magazine. The adjacent needle holder effecting the uncoupling thus automatically arrives at the coupling position.

This successive uncoupling and coupling of the row of needle holders takes place until the desired needle holder is connected to the needle bar. Then, the needle bar is lowered again into the top dead center of the working stroke, which withdraws the needle holder from the magazine so that during the following embroidering operation, the needle holder does not come into contact with the magazine.

Since the working stroke is followed by a long switching stroke, the total stroke of the needle bar is relatively very large and requires correspondingly spaced-apart bearing points. Further, another drive is needed for the switching stroke, so that the entire support and drive of the needle bar becomes a bulky construction requiring a correspondingly voluminous housing. In an embroidering machine, this raises no problems, since the size of the housing may easily be adapted to the space occupied by the mechanism. Considerable difficulties would be encountered, however, with an application of such a construction to conventional sewing machines.

SUMMARY OF THE INVENTION

The present invention is directed to a thread changing mechanism requiring a so limited space that it can be employed in embroidering machines as well as in conventional sewing machines.

Due to the provision that the coupling and uncoupling is effected in the top dead center of the working stroke of the needle bar by merely shifting the needle holder transversely to the longitudinal axis of the needle bar, the thread changing mechanism becomes usable for both embroidering machines and sewing machines having standard drives of needle bars. The spacer elements provided at least between the coupling needle holder and the two adjacent ones and spacing them apart, ensure, along with the recess in the magazine, a low-wear operation of the thread changing mechanism by eliminating a contact during the stitch formation between the needle holder connected to the needle bar, and both the magazine and the other needle holders. The spacer elements and the recess in the magazine also make possible a particularly simple construction and function of the mechanism, since neither a switching stroke nor a bypassing by the magazine is necessary for separating or spacing apart the needle holder coupled to the needle bar and the magazine and the other needle holders received therein.

In accordance with the invention, the sewing machine includes a reciprocating needle bar with needle holder magazine having a plurality of needle holders in the magazine which may be selectively engaged with the needle bar and which incudes means for spacing the holders apart in the needle holder in a manner to permit the engaged needle holder to reciprocate with the needle bar without interfering with the other holders.

In one embodiment the arrangement includes spacer members which are movable between the individual holders to keep them spaced apart as one of them is positioned in a recess of the magazine which accommodates its vertical reciprocation without interference with the other needle holders which are maintained idle. The arrangement also includes means for clamping the thread of the non-engaged holders during the time of the reciprocation of the engaged holder with the needle bar. Clamping means are such that the holder which is engaged with the needle bar is presented to a mechanism which disengages the clamping element.

Accordingly, it is an object of the invention to provide a sewing machine having a magazine for needle holders which includes means for spacing the needle holders apart so that they may reciprocate easily and preferably also includes means for holding the thread of those needle holders which are disengaged.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments are illustrated.

BRIEF DESCRIPTION OF THE DRAWINGS

In the drawings:

FIG. 3 is a sectional view taken along the line III—III of FIG. 1;

FIG. 4 is a sectional view taken along the line IV—IV of FIG. 3;

FIG. 5 is a sectional view taken along the line V—V of FIG. 4; and

DESCRIPTION OF THE PREFERRED EMBODIMENTS

Figure 1:
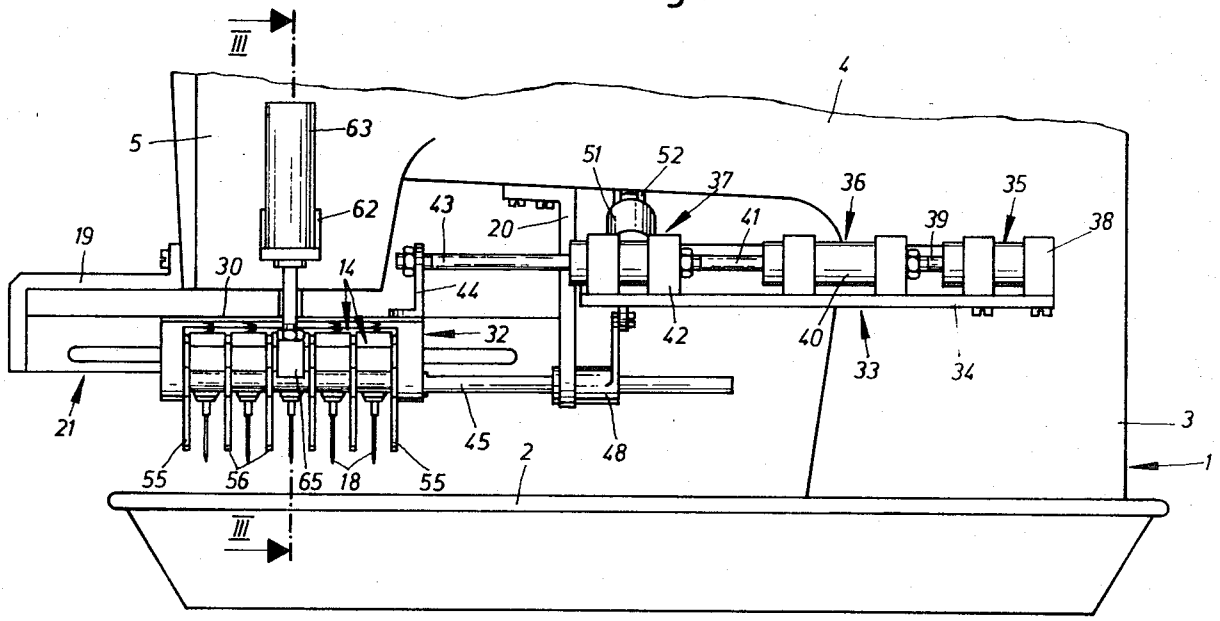
FIG. 1 is a partial side elevational view of a sewing machine with a thread changing mechanism constructed in accordance with the invention.
Figure 2:
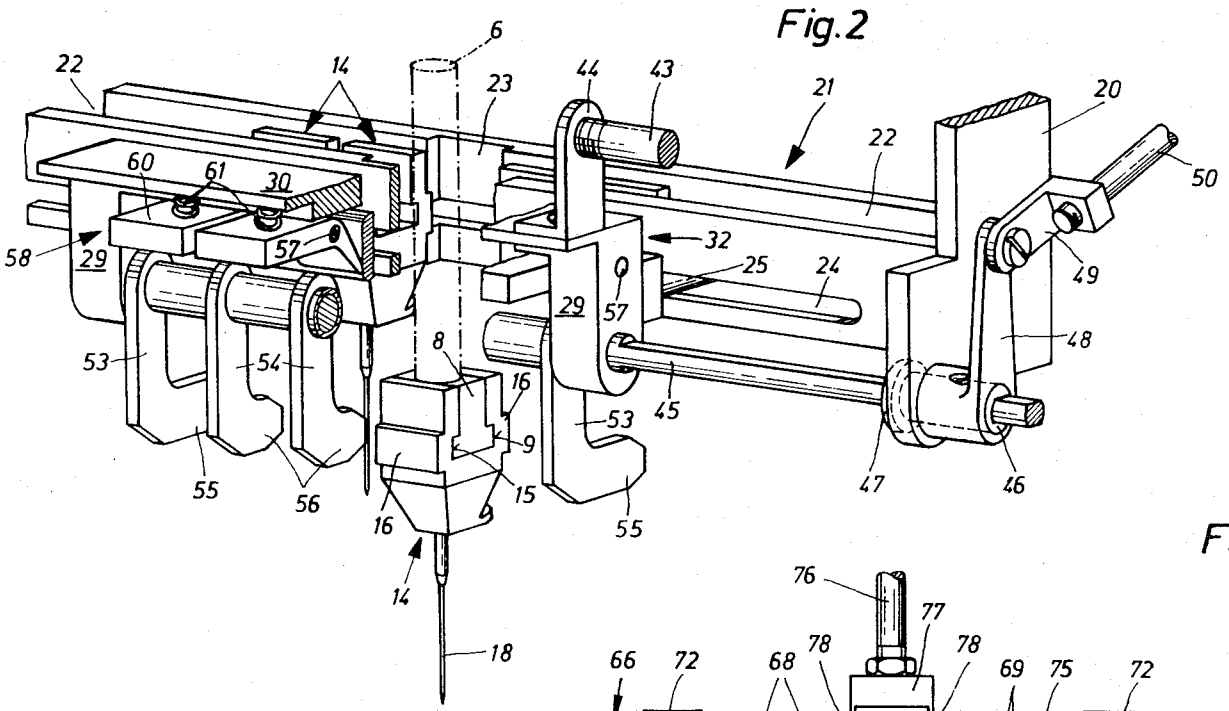
FIG. 2 is a perspective view of the thread changing mechanism.

Referring to the drawings in particular, the invention embodied therein comprises a sewing machine generally designated 1 which includes a reciprocating needle bar designated 6 in FIGS. 2 and 3 which operates in conjunction with a needle holder magazine 21 having a plurality of separate needle holders 14. Mounting means are provided which includes support plates 19 and 20 for securing into a head portion 5 and an arm portion 4 of the sewing machine 1 of a magazine 21 for a plurality of holders 14. Needle holders 14 are movable within the magazine 21 transversely to the longitudinal axis of the needle bar. The magazine is preferably mounted at the level of the top dead center of the path of motion of the coupled needle holder and the magazine itself includes a recess in which the holder which is connected is vertically movable. To ensure that the coupled needle holder moves unobstructed, spacer elements are provided for keeping the needle holders apart or the engaged needle holder may be separated from the others by means of a fork shaped member which is inserted between the engaged member and the rest of the needle holders.

The sewing machine comprises a housing 1 including a base plate 2, a post 3, and an arm 4 which terminates with a head 5. In a manner known per se, a needle bar 6 is mounted for up and down movement in head 5.

Secured in the hollow needle bar 6 is a pin 7 of a coupling member 8. Coupling member 8 is designated with protruding shoulders forming outer guide surfaces 9 which give the member a T cross-section. Coupling member 8 is further provided with a vertical axial bore 10 which is narrowed at its lower end and accommodates a ball 11. Ball 11 is urged downwardly by a compression spring 13 bearing by its other end against a cross pin 12, with a portion of ball 11 protruding below the lower end of coupling member 8.

Coupling member 8 carries an exchangeable needle holder 14 which is provided with inner guide surfaces 15 which oppose and extend parallel to guide surfaces 9 of coupling member 8. Needle holder 14 is designed with two projections forming guide surfaces 16 which extend parallel to inner guide surfaces 15. In the horizontally extending bottom portion of needle holder 14, a shallow recess 17 is provided into which ball 11 engages to positively secure needle holder 14 against lateral displacement relative to the coupling member 8. Needle holder 14 carries a thread guiding needle 18 which cooperates, in a manner known per se, with a rotary hook (not shown).

A magazine 21 for a total of five needle holders 14 extends parallel to the longitudinal axis of the sewing machine and is mounted by means of two supporting plates, a plate 19 secured to head 5, and a plate 20 secured to arm 4. Magazine 21 is designed with a guide channel 22 extending parallel to the longitudinal axis of the magazine and having a shape and width adjusted to those of needle holders 14, to make the holders displaceable within the channel 22. The magazine 21 is arranged to have all the non-coupled needle holders 14 received therein spaced vertically from base plate 2 by the same distance by which the needle holder 14 just coupled to the needle bar 6, with the needle bar occupying exactly its upper dead center position, is spaced from the base plate. In the middle of magazine 21, in the displacement zone of needle bar 6, a vertically extending recess 23 is provided which is wider and deeper than the corresponding dimensions of needle holder 14. Therefore, the needle holder 14 coupled to needle bar 6 has no contact with magazine 21.

Two opposite lateral slots 24 at the same level are provided in magazine 21. A flattened bolt 25 extends at either side of the group of needle holders 14 through the slots 24, crosswise to the longitudinal axis of the magazine, and is displaceable therein. Bolts 25 engage blind bores 26 of a plate 27 which applies against the front side of magazine 21, and are screwed by threaded extensions 28 to the legs 29 of a U-shaped bracket 30. To each of the other ends of bolts 25, a holding washer 31 is secured applying against the back side of magazine 21. Component parts 25 to 31 form a frame 32 which is displaceable relative to magazine 21.

Frame 32 is connected to a so-called multiposition cylinder 33 comprising a rail 34 which is secured to post 3 and three series connected double-acting air cylinders 35,36,37. Housing 38 of air cylinder 35 is secured to rail 34 and the piston rod 39 is connected to the housing 40 of air cylinder 36. Housing 40 is displaceable on rail 34. Piston rod 41 is firmly secured to housing 42 of air cylinder 37. Housing 42 also is displaceable on rail 34. Piston rod 43 of air cylinder 37 is firmly connected to an angle plate 44 which is secured to bracket 30.

Air cylinders 35 and 37 have a stroke of 20 mm, air cylinder 36 has a stroke of 40 mm. By providing a cylinder actuation individually, in groups, or altogether, frame 32 can be brought into five different positions, with the adjacent positions being successively 20 mm apart.

A shaft 45 is mounted on legs 29 of bracket 30, and secured against axial displacement, so that it is axially displaced with frame 32. Shaft 45 extends by a flattened portion beyond frame 32. The flattened portion of shaft 45 is displaceable in a bushing 46 having its bore conformed to the shaft. Bushing 46 is mounted for rotation in supporting plate 20 and provided with a collar 47. Secured to bushing 46 is a crank 48 which is connected through a link 49 to the piston rod 50 of an air cylinder 51. Air cylinder 51 is pivoted to an angle plate 52 secured to arm 4.

To the portion extending between legs 29 of shaft 45, two outer fingers 53 and four inner fingers 54 are secured. Fingers 53 and 54 have end portions 55, 56 projecting at an angle, and are provided at locations equidistantly spaced from each other by the width of a needle holder 14. The angled end portions 55 of outer fingers 53 are longer than those 56 of inner fingers 54.

On a bolt 57 carried by the two legs 29 above fingers 53, 54, five clamping levers 58 are mounted for free pivoting, each having a clamping arm 59 and a switching arm 60. Each of clamping levers 58 is biased by a compression spring 61 bearing against bracket 30, so that clamping arms 59 are urged into contact with plate 27. Plate 27 has rounded edges.

An air cylinder 63 is supported on an angle plate 62 which is secured to head 5. The piston rod 64 of air cylinder 63 carries an engaging hook 65. Air cylinder 63 is provided in front of the needle bar 6, so that hook 65 is always in a position below switching arm 60 of the clamping lever 58 which is just associated with the needle holder 14 coupled to needle bar 6.

Figure 6:
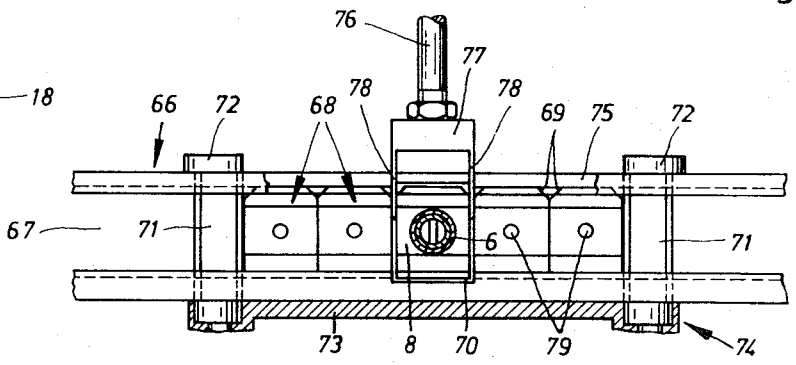
FIG. 6 is a partial sectional view similar to FIG. 4, of another embodiment of the mechanism.

In the second embodiment shown in FIG. 6, the thread changing mechanism comprises a magazine 66 which is identical in design with magazine 21 and is secured to the housing of the sewing machine in the same way. Magazine 66 has a guide channel 67 for a total of five needle holders 68 which differ from needle holders 14 of the first embodiment only by having each two vertically extending chamfers 69. The through-recess extending in the vertical direction and provided in the middle of magazine 66 in the motion zone of needle bar 6, is indicated at 70. Displaceable on magazine 66 is a frame 74, comprising two flattened bolts 71, two holding washers 72, and a plate 73, with bolts 71 being engaged in two opposite lengthwise slots 75 of magazine 66. Frame 74 is connected to a multi-position cylinder (not shown) corresponding to cylinder 33 of the first embodiment and carries a clamping lever (not shown) for each of needle holders 68, corresponding to clamping levers 58 of the first embodiment.

A fork 77 with two prongs 78 is secured to the horizontally extending piston rod 76 of an air cylinder (not shown). The height of prongs 78 is dimensioned to make the prongs introducible through the rear slot 75 into the guide channels 67, and between coupled needle holder 68 and the two adjacent needle holders 68. The mutual spacing of prongs 78 corresponds to the width of needle holder 68, and the mutual spacing of the two bolts 71 corresponds to the product of the width of a needle holder and their number, plus the product of the width of prongs 78 and their number.

The mechanism operates as follows:

In the first embodiment shown in FIGS. 1–5, the medial needle holder 14 is coupled to the needle bar 6. The other four needle holders 14 are received in guide channel 22 of magazine 21. During a sewing operation, air cylinder 51 holds fingers 53,54 in their lowered bottom position shown in FIGS. 1–3. Further air cylinder 63 holds the clamping lever 58 associated with a respective coupled needle holder 14 in the pivotal position shown in FIG. 3, in which clamping arm 59 is disengaged from plate 27. With this pivotal position of clamping lever 58, the needle thread (not shown) threaded in the needle 18 of the coupled needle holder 14 runs unobstructed between plate 27 and clamping arm 59 toward the thread bobbin (not shown). The other four clamping levers 58 associated with the non-coupled needle holders 14 in magazine 21, apply by their clamping arms 59 to plate 27 thereby clamping the needle threads (not shown) extending between the associated needles and the respective thread bobbins.

The five needle holders 14 are spaced from each other by a distance exactly corresponding to the width of end portions 56 of fingers 54. Further, the two outer needle holders 14 are spaced from the respective adjacent bolt 25 by a distance exactly corresponding to the width of end portion 55 of the two outer fingers 53. Therefore, a coupled needle holder 14 in a position within recess 23 of magazine 21 and with the needle bar 6 in its upper dead center position, has no contact with magazine 21 nor with the adjacent needle holders 14 or bolts 25. The coupled needle holder 14 can thus be moved by needle bar 6 up and down entirely freely and unhindered. Since these component parts of the thread changing mechanism operate directly above the work and are partly exposed, they must be lubricated only very slightly, to avoid soiling. Consequently, in every dead center position of needle bar 6, a contact between the coupled needle holder and magazine 21 or the adjacent needle holders, would result in a premature wear.

The non-coupled needle holders 14 displaceably received in magazine 21 are held fast in their positions in a satisfactory manner either by a suitable in fit in guide channel 22, or positively by spring elements (not shown), to the effect that they cannot of themselves change their positions within the magazine.

To change a needle holder 14, the sewing machine is stopped with the needle bar 6 in the top dead center position. Hook 65 is then lowered by air cylinder 63 so that the clamping lever 58, associated with hitherto coupled to needle holder 14, applies against plate 27. Simultaneously, fingers 53,54 are moved by air cylinder 51 into their lifted pivotal positions shown in FIGS. 4, 5. This brings end portions 55 of the two outer fingers 53 into the gaps between the outer needle holders 14 and the respective bolts 25, and end portions 54 into the gaps between needle holders 14. The length of end portions 56 is so dimensioned that in the upper pivotal positions shown in FIG. 5, they are slightly spaced from the lower end of coupling member 8.

After bringing fingers 53,54 into their upper pivotal position, frame 32 is moved by multiposition cylinder 33 relative to magazine 21, so that bolts 25 along with fingers 53,54 displace needle holders 14 within guide channel 22. The hitherto coupled needle holder 14 is thereby shifted sidewards, away from coupling member 8, and introduced into guide channel 22, and the adjacent needle holder 14 is engaged on coupling member 8 instead. This operation is repeated until the selected needle holder 14 is coupled to needle bar 6. Thereupon, the three air cylinders 35,36,37 of multiposition cylinder 33 are vented. Since, during the displacement of the needle holders 14, all needle threads are held fast by clamping levers 58, the needle threads cannot become unthreaded from needles 18.

After the coupling of the new needle holder 14 is effected, fingers 53,54 are moved back into their lower pivotal positions, and the clamping lever 58 associated with coupled needle holder 14 is disengaged from plate 27, whereupon the next sewing operation can start.

In the second embodiment shown in FIG. 6, to change a needle holder 68, frame 74 is moved by the multiposition cylinder (not shown) relative to magazine 66, with fork 77 being retracted. This causes the respective trailing bolt 71 to push the needle holders 68 first together, to a gapless block, and then conjointly within guide channel 67. Thereby, as in the first embodiment, the hitherto coupled needle holder 68 is shifted laterally away from guide channel 67 and the adjacent needle holder 68 is engaged on coupling member 8 instead. This operation is repeated until the desired needle holder 68 is coupled to needle bar 6. The three air cylinders of the multiposition cylinder are then vented.

Since the distance between bolts 71 exceeds by the double width of prongs 78 the total width of needle holders 68 pushed together to a gapless block, the needle holder 68 to be coupled is engaged onto coupling member 8 in a position which is off-center by the width of a prong 78. This causes the spring-loaded ball of coupling member 8, which already protrudes into recess 79 of needle holder 68, to shift the coupled needle holder 68 into the exact coupling position. The needle holder 68 located between the coupled needle holder 68 and the leading bolt 71 is thereby also shifted in the direction of this bolt 71.

Upon effecting the coupling of needle holder 68, fork 77 is temporarily introduced into guide channel 67, with the two prongs 78 engaging between coupled needle holder 68 and the two adjacent needle holders 68. The needle holder 68 located between the coupled one and the leading bolt 71 are thereby further shifted in the direction of this bolt 71, until the outer needle holder 68 applies thereto. In instances where the compression spring acting on the bolt was not strong enough to move the coupled needle holder 68 into the exact coupling position, this is now effected by fork 77.

Upon retracting fork 77 and with needle bar 6 being in the upper dead center position, the coupled needle holder 68 is in a position within recess 70 of magazine 66, in which it has no contact with the magazine nor with the adjacent needle holder 68 of bolts 71. The coupled needle holder can thus be moved by needle bar 6 up and down freely and unobstructed. While specific embodiments of the invention have been shown and described in detail to illustrate the application of the principles of the invention, it will be understood that the invention may be embodied otherwise without departing from such principles.

What is claimed is:

1. In a sewing machine including a reciprocating needle bar for reciprocating a thread needle having thread fed thereto, the improvement comprising a needle holder magazine, a plurality of needle holders in said magazine, means mounting said holders in said magazine for movement across the path of movement of said needle bar for selectively aligning a selected one of said needle holders with the needle bar, said magazine having a holder receiving recess aligned with said needle bar, displacement means engageable with said holders to shift said holders relative to said needle bar so as to align a selected holder with the recess, and thread clamping means engageable with said holders for engaging against thread fed thereto to hold the thread, and means associated with said thread clamping means to disengage said thread clamping means when said magazine is engaged with said needle bar.

2. In a sewing machine according to claim 1, wherein said needle bar is movable downwardly and back to a top dead center position, said mounting means mounting said magazine at the level of the top dead center position.

3. In a sewing machine according to claim 1, including spacer means to space said needle holders apart in said magazine.

4. In a sewing machine according to claim 3, wherein said spacer means comprises a plurality of separate spacer members pivotally mounted adjacent said holders and being movable into the space between said holders.

5. In a sewing machine according to claim 3, wherein said spacer means includes a forked member, said holders having butting sides with bevelled edges, said fork member being introducible into space between the bevelled edges to separate said holder.

6. A sewing machine comprising a needle bar movable downwardly and backwardly to a top dead center position, a needle holder magazine mounted adjacent said needle bar and extending transversely thereof, a plurality of needle holders in said magazine, said magazine being of a length to permit said holders to be shifted relative to each other, means mounting said needle holders in said holder magazine for movement across the path of movement of said needle bar for selectively aligning one of said needle holders with said needle bar, displacement means engageable with said needle holders to shift them relative to said needle bar, said magazine having a holder receiving recess aligned with said needle bar to permit vertical reciprocation of the holder therein which is coupled to said needle bar, and a movable spacer element mounted adjacent said magazine for movement into and out of the space between said magazine needle holders.

7. A sewing machine according to claim 6, including a spacer element corresponding to the number of needle holders for engaging between said needle holders, said spacer being movable to separate said needle holders and being movable away from said needle holders after the space therebetween is effected.

8. A sewing machine according to claim 6, wherein said magazine includes a frame, means connected to said frame to displace it transversely to the path of movement of said needle bar and including a movable shaft and a bolt connected to each end of said magazine and to said shaft, and a plurality of spacer fingers pivoted to said shaft and being displaceable into and out of engagement between said needle holders.

9. A sewing machine according to claim 6, wherein said spacers comprise a fork member having prongs engageable between a selected needle holder and the next adjacent needle holders.

* * * * *